US007475881B2

(12) United States Patent
Blagg et al.

(10) Patent No.: US 7,475,881 B2
(45) Date of Patent: Jan. 13, 2009

(54) FIGHTING FIGURE GAME

(75) Inventors: Benjamin Blagg, Los Angeles, CA (US); Stephen Lau, Torrance, CA (US); Erich Weidetz, Playa Del Rey, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 11/592,727

(22) Filed: Nov. 2, 2006

(65) Prior Publication Data

US 2007/0128973 A1 Jun. 7, 2007

Related U.S. Application Data

(60) Provisional application No. 60/733,354, filed on Nov. 3, 2005.

(51) Int. Cl.
*A63F 9/00* (2006.01)

(52) U.S. Cl. ..... 273/440.1

(58) Field of Classification Search ..... 273/440, 273/440.1, 459–461; 446/334, 336
See application file for complete search history.

(56) References Cited

U.S. PATENT DOCUMENTS

| | | | |
|---|---|---|---|
| 1,605,738 | A | 11/1926 | Idemoto |
| 1,736,163 | A | 11/1929 | McGee |
| 1,745,434 | A | 2/1930 | McIntosh |
| 1,781,307 | A | 11/1930 | Veronda |
| 1,799,735 | A | 4/1931 | Crowell |
| 1,812,930 | A | 7/1931 | Chester |
| 2,088,510 | A | 7/1937 | Frasca |
| 2,269,095 | A | 1/1942 | Davis |
| 2,496,725 | A | 2/1950 | Hotcaveg |
| 2,538,744 | A | 1/1951 | Berry |
| 2,586,432 | A | 2/1952 | Land |
| 2,716,840 | A | 9/1955 | Armstrong |
| 2,760,306 | A | 8/1956 | Pelletier |
| 3,106,800 | A | 10/1963 | Fletcher |
| 3,135,444 | A | 6/1964 | Schoenfeld |
| 3,235,259 | A | 2/1966 | Glass et al. |
| 3,303,605 | A | 2/1967 | Henry |
| 3,758,982 | A | 9/1973 | Lemelson et al. |
| 3,845,956 | A | 11/1974 | Goldfarb et al. |

(Continued)

FOREIGN PATENT DOCUMENTS

| | | |
|---|---|---|
| JP | H07-059940 | 3/1995 |

(Continued)

OTHER PUBLICATIONS

Translation (computerized) of JP H07-059940 from JPO.

(Continued)

*Primary Examiner*—Raleigh W. Chiu
(74) *Attorney, Agent, or Firm*—Cantor Colburn LLP

(57) ABSTRACT

A fighting figure game may include a base, a first figure, and a second figure. The first figure may include a body selectively movable relative to the base and a head configured to move upwardly away from the body of the first figure in response to an impact to the first figure. The second figure may include a body selectively movable relative to the base and a head configured to pivot relative to the body of the second figure in response to an impact to the second figure.

20 Claims, 4 Drawing Sheets

U.S. PATENT DOCUMENTS

| | | | |
|---|---|---|---|
| 3,848,357 | A | 11/1974 | Morrison |
| 3,856,304 | A | 12/1974 | Matsumoto et al. |
| 3,864,870 | A | 2/1975 | Breslow et al. |
| 3,927,883 | A | 12/1975 | Bosley et al. |
| 3,969,841 | A | 7/1976 | Joseph |
| 4,031,657 | A | 6/1977 | Crosman et al. |
| 4,069,613 | A | 1/1978 | Lemelson et al. |
| 4,091,563 | A | 5/1978 | Noble et al. |
| 4,319,751 | A | 3/1982 | Kurushima et al. |
| 4,366,960 | A | 1/1983 | Bromley et al. |
| 4,367,875 | A | 1/1983 | Barlow et al. |
| 4,398,717 | A | 8/1983 | Rosenfeld et al. |
| 4,457,097 | A | 7/1984 | Miller et al. |
| 4,530,671 | A | 7/1985 | Mednick et al. |
| 4,609,195 | A | 9/1986 | Ham |
| 4,844,461 | A | 7/1989 | Namanny et al. |
| 4,995,610 | A | 2/1991 | Paoletti |
| 5,009,424 | A | 4/1991 | Harth et al. |
| 5,042,807 | A | 8/1991 | Sasakawa et al. |
| 5,046,987 | A | 9/1991 | Djordjevic |
| 5,181,727 | A | 1/1993 | Fukumura |
| 5,458,523 | A | 10/1995 | Aoki et al. |
| D387,822 | S | 12/1997 | Dawson |
| 5,732,953 | A | 3/1998 | Tamura |
| 6,238,215 | B1 | 5/2001 | Jurmain et al. |
| 6,280,286 | B1 | 8/2001 | Andrews |
| 6,682,392 | B2 | 1/2004 | Chan |

FOREIGN PATENT DOCUMENTS

| | | |
|---|---|---|
| JP | 2003-079964 | 3/2003 |

OTHER PUBLICATIONS

Translation (computerized) of JP 2003-079964 from JPO.

FIGHTING FIGURE GAME

This application claims the benefit of U.S. Provisional Patent Application Ser. No. 60/733,354, filed Nov. 3, 2005. The complete disclosure of the above-identified patent application is hereby incorporated by reference in its entirety for all purposes.

FIELD OF THE DISCLOSURE

The present disclosure relates generally to games and, more particularly, to games where a plurality of players manipulate figures in a simulated boxing match.

BACKGROUND OF THE DISCLOSURE

Examples of toys simulating boxing matches are disclosed in U.S. Pat. Nos. 2,269,095, 2,716,840, 3,106,800, 3,235,259, 3,856,304, 4,031,657, 4,069,613, 4,366,960, 4,367,875, 4,995,610, and 5,732,953. The disclosures of these and all other publications referenced herein are incorporated by reference in their entirety for all purposes.

SUMMARY OF THE DISCLOSURE

In one example, a fighting figure game includes a base, a first figure, and a second figure. The first figure may include a first body selectively movable relative to the base, at least a first appendage coupled to and extending from the first body, and a first head mounted to the first body. The first head may be movable relative to the first body between a first position proximate the first body and a second position spaced upwardly away from the first body. The second figure may include a second body selectively movable relative to the base, at least a second appendage coupled to and extending from the second body, and a second head mounted to the second body. The second head may be pivotingly movable relative to the second body between a third position and a fourth position.

In one example, a fighting figure game includes a base, which may extend generally along a base plane, and a pair of opposed figures that may be independently selectively movable along the base. Each figure of the pair of figures may include a body and at least one appendage, which may be coupled to the body and configured to selectively extend away from the body. A first figure of the pair of figures may further include a head configured to move upwardly relative to the body of the first figure in response to the first figure being struck. A second figure of the pair of figures may further include a head configured to pivot relative to the body of the second figure in response to the second figure being struck.

In one example, a fighting figure game includes a base, a first figure, and a second figure. The first figure may include a body selectively movable relative to the base and a head configured to move upwardly away from the body of the first figure in response to an impact to the first figure. The second figure may include a body selectively movable relative to the base and a head configured to pivot relative to the body of the second figure in response to an impact to the second figure.

DETAILED DESCRIPTION

Figure 1:
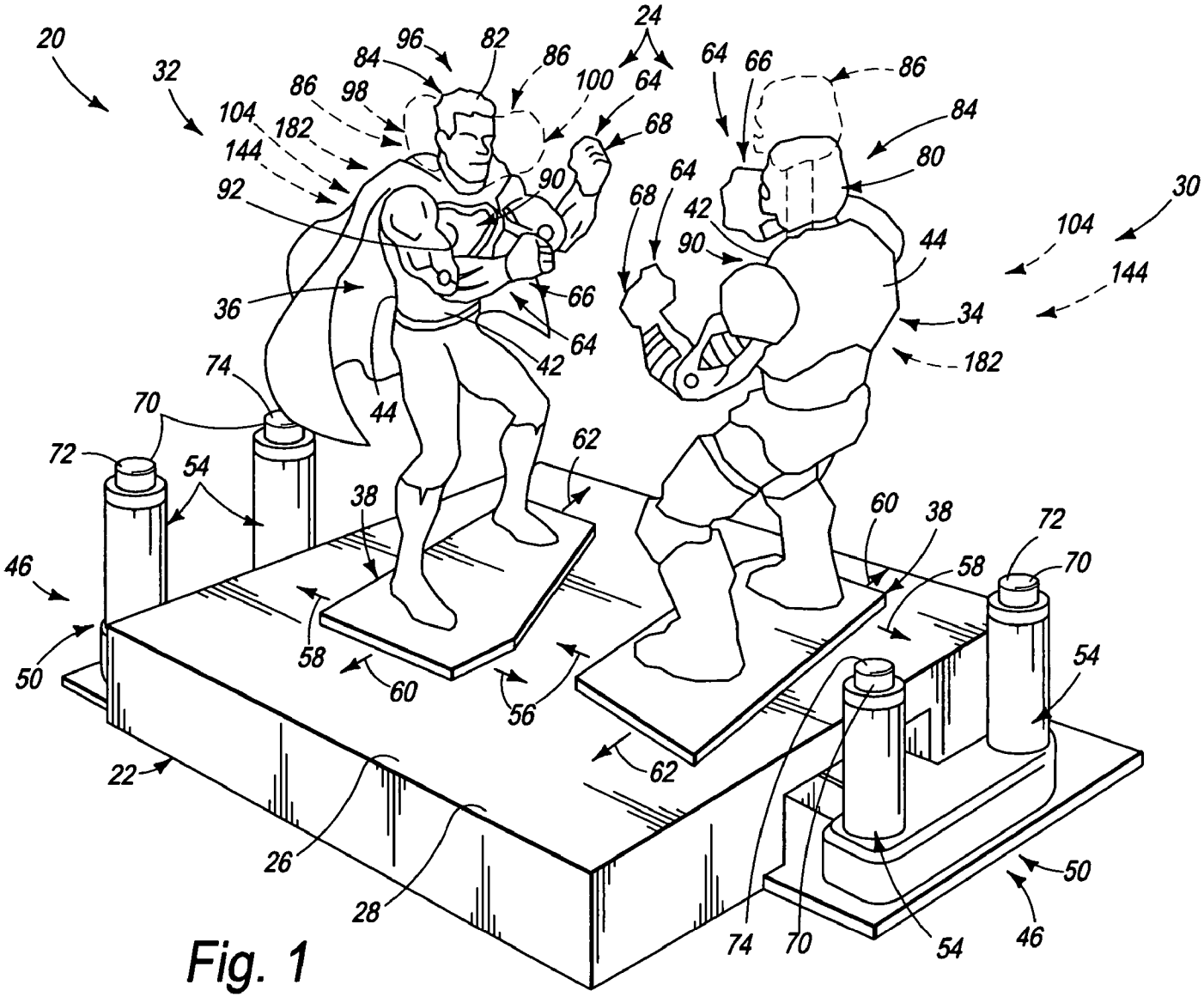
FIG. 1 is a perspective view of a fighting figure game.
Figure 2:
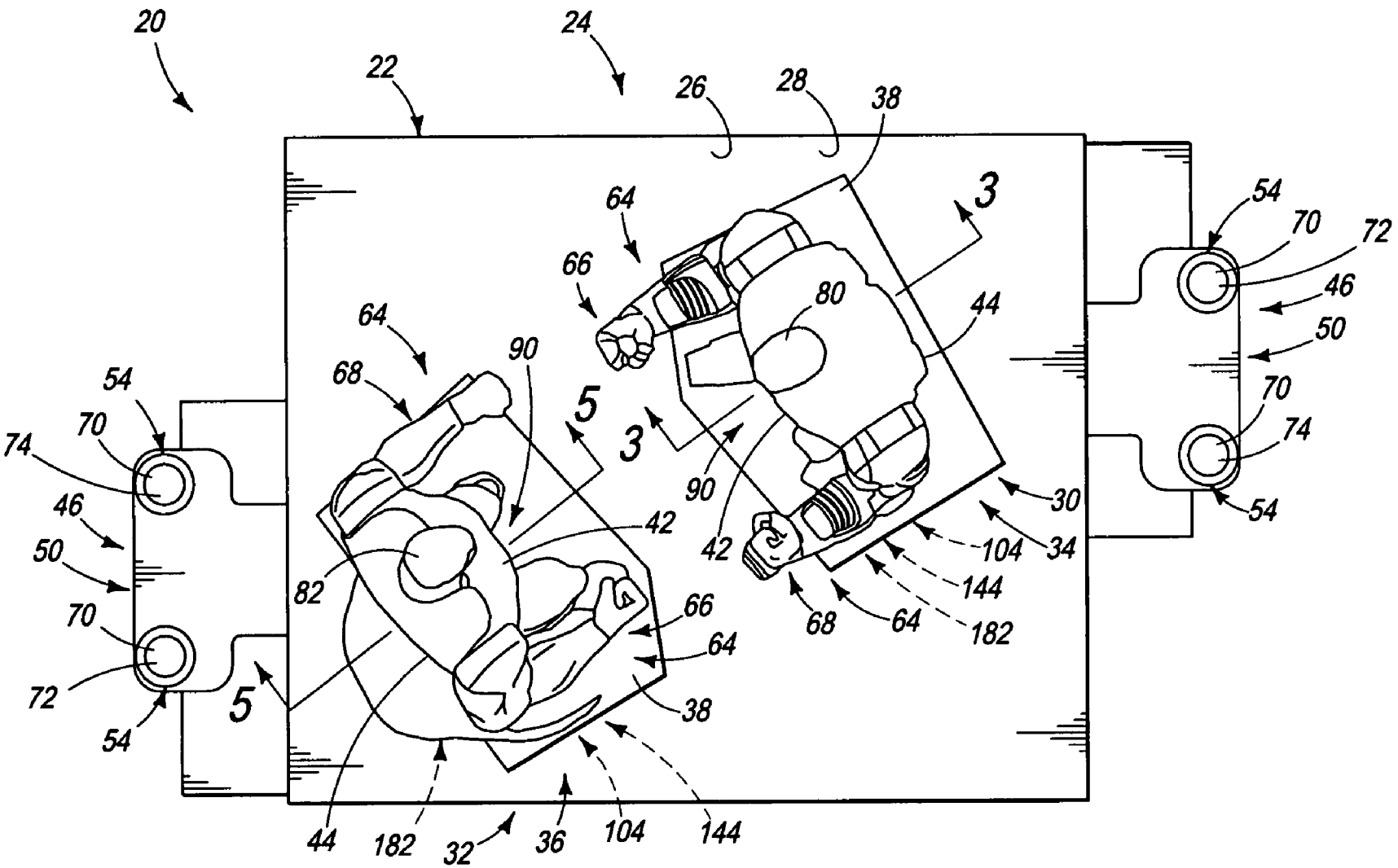
FIG. 2 is a top view of the fighting figure game of FIG. 1.

A nonexclusive illustrative example of a fighting figure game is shown generally at 20 in FIGS. 1 and 2. Unless otherwise specified, fighting figure game 20 may, but is not required to, contain at least one of the structure, components, functionality, and/or variations described and/or illustrated herein.

Fighting figure game 20 may include a platform or base 22, and a pair of opposed figure 24. As shown in the nonexclusive illustrative example presented in FIGS. 1 and 2, base 22 includes a top surface 26, which may extend generally along a base plane 28. The pair of opposed figures includes a first figure 30 and a second figure 32. Each of the first and second figures 30, 32 may include a body 34, 36, respectively, that is independently selectively movable relative to base 22. For example, the bodies 34, 36 of the respective ones of the first and second figures 30, 32 may be disposed on a platform 38, which is movable relative to base 22, as shown in FIGS. 1 and 2. Each of the bodies of the first and second figures 30, 32 may have a front 42 and a rear 44.

Fighting figure game 20 may include a control assembly 46 associated with each of the first and second figures 30, 32. Each control assembly 46 may include at least one control handle 50 that is coupled to the platform 38 associated with each of the first and second figures 30, 32. As shown in the nonexclusive illustrative example presented in FIGS. 1 and 2, each control handle 50 may include a pair of handgrips 54 to permit a player to grasp the control handle with both hands. The control assemblies may generally be coupled to the associated platforms and associated ones of the first and second figures using any suitable mechanisms and/or structures, such as ones that are generally similar to those disclosed in U.S. Pat. No. 3,235,259 to Glass et al., the complete disclosure of which is incorporated by reference in its entirety for all purposes.

During use of fighting figure game 20, a player or players may manipulate one or more control assembly 46, such as by moving the control handle 50, to move manually the associated one of the first and second figures 30, 32 relative to base 22. Each control assembly 46 may be configured to move the associated platform 38 and figure 30, 32 laterally relative to the base 22, such as in at least one direction that is generally along or parallel to base plane 28. For example, as shown in the nonexclusive illustrative example presented in FIGS. 1 and 2, through appropriate manipulation of a control handle 50, the associated one of the first and second figures 30, 32 may be selectively moved in a forward direction 56, a rearward direction 58, a rightward direction 60, and/or a leftward direction 62.

Each of the first and second figures 30, 32 may include at least one appendage 64 that is coupled to the respective bodies 34, 36 of the first and second figures 30, 32. The appendages 64 may extend away from the respective bodies 34, 36, such as where the appendage 64 is configured as an arm of the first or second figures 30, 32. As shown in the nonexclusive illustrative example presented in FIGS. 1 and 2, each of the first and second figures 30, 32 may include a pair of appendages 64 that are configured as first and second arms 66, 68.

In some embodiments, at least one of the appendages 64 of each of the first and second figures 30, 32 may be configured as a striking appendage that may be selectively extended away from the body of the associated figure. As shown in the nonexclusive illustrative example presented in FIGS. 1 and 2, at least one of the first and second arms 66, 68 of at least one of the first and second figures 30, 32, such as first figure 30, may be selectively extendable away from the body of the figure, such as to strike an object, such as the opposing one of the first and second figures 30, 32, such as second figure 32.

Each control assembly 46 may include at least one actuator 70 disposed on each control handle 50 such that manipulation of the control assembly may enable extension of at least one of the appendages of the respective one of the first and second figures 30, 32 that is associated with a particular control assembly 46. As shown in the nonexclusive illustrative example presented in FIGS. 1 and 2, actuator 70 may include first and second buttons 72. 74 disposed on control handles 50, such as, a button on each handgrip 54. Each of the first and second buttons 72, 74 on control handles 50 may be operatively linked to a respective one of the first and second arms 66, 68 of the respective one of the first and second figures 30, 32 that is associated with each control handle 50. The buttons may be operatively linked to the arms of the figures using any suitable mechanisms and/or structures, such as ones that are generally similar to those disclosed in U.S. Pat. No. 3,235,259 to Glass et al. The operative linkages between the first and second buttons 72, 74 and the first and second arms 66, 68 may permit a user to selectively extend at least one of the first and second arms 66, 68 of a figure by depressing at least one of the first and second buttons 72, 74. In some embodiments, the operative linkages between the first and second buttons 72, 74 and the first and second arms 66, 68 may be configured to extend the associated first and second arms 66, 68 with a force that is proportional to the force with which the first and second buttons 72, 74 have been depressed. For example, a user may cause the arm associated with a particular button to extend with a greater force merely by depressing the button with a greater force.

Each of the first and second figures 30, 32 may include a respective head 80, 82 that is mounted to the respective body 34, 36 of the associated one of the first and second figures 30, 32. Each of the heads 80, 82 may be movably mounted to the corresponding body 34, 36. As shown in the nonexclusive illustrative example presented in FIGS. 1 and 2, the heads 80, 82 of the first and second figures 30, 32 may be configured to move relative to the associated body 34, 36 between a first position 84 and a second position 86. In some embodiments, the head 80, 82 of at least one of the first and second figures 30, 32 may be configured to move between the first position 84 and the second position 86 in response to an impact to the figure, such as when the figure is struck, such as by another figure.

In some embodiments, the head 80, 82 of at least one of the respective first and second figures 30, 32 may be configured to move between the first position 84 and the second position 86 in response to an impact to a chest region 90 of the figure. As shown in the nonexclusive illustrative example presented in FIGS. 1 and 2, the chest region 90 of at least one of the first and second figures 30, 32 may include a chest button 92. A figure having a chest button 92 may be configured such that an impact to the chest button 92 may enable the head of the figure to move between the first position 84 and the second position 86. For example, the respective head 80, 82 of at least one of the first and second figures 30, 32 may be configured to move between the first position 84 and the second position 86 when an opposing figure strikes the chest region 90 of the at least one figure, such as where the opposing figure strikes the chest button 92.

In some embodiments, at least one of the first and second figures 30, 32 may be configured such that an impact of at least a predetermined force to the chest region 90 of the figure may be necessary to enable the head 80, 82 of the figure to move from the first position 84 toward the second position 86. For example, at least one of the first and second figures 30, 32 may be configured such that impacts to the chest region 90 that are less than the predetermined force do not enable the head 80, 82 of the figure to move from the first position 84 toward the second position 86. A suitable value for the predetermined force may correspond to a force that may be readily delivered by an extending arm of the first or second figure 30, 32. For example, the predetermined force may be greater than the minimal force deliverable by an extending arm of the first or second figure 30, 32 but less than the maximum force deliverable by an extending arm of the first or second figure 30, 32. In some embodiments, repeated impacts of less than the predetermined force to the figure may enable the head 80, 82 to move from the first position 84 toward the second position 86.

In some embodiments of fighting figure game 20, the heads 80, 82 of the first and second figures 30, 32 may exhibit a different response to an impact to the figure, such as an impact to the chest region 90. For example, the head of at least one of the first and second figures 30, 32 may transition from a "normal" first position 84 to a "disabled" or "injured" second position 86 in response to an impact to the figure.

In a first exemplary head response, the head 80 of first figure 30 may be configured to move upwardly away from the body 34 of first figure 30 in response to an impact to first figure 30. As shown in the nonexclusive illustrative example presented in FIGS. 1 and 2, the head 80 of first figure 30 is movable relative to the body 34 of first figure 30 between a first position 84, in which the head 80 is proximate body 34, and a second position 86, in which the head 80 is spaced upwardly away from the body 34.

Figure 5:
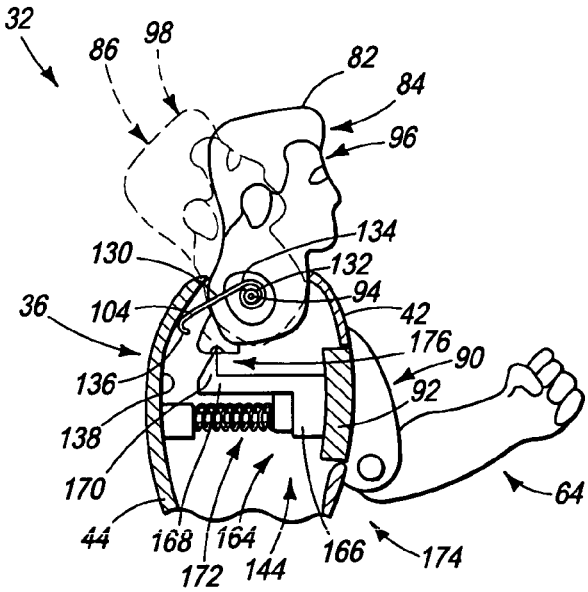
FIG. 5 is a partial sectional view of a figure suitable for use with a fighting figure game, taken generally along line 5-5 in FIG. 2, which shows a nonexclusive illustrative example of a mechanism for pivotingly moving the head of the figure relative to the body, with a retention member shown in an engaged position and the head shown retained in an upright position.
Figure 6:
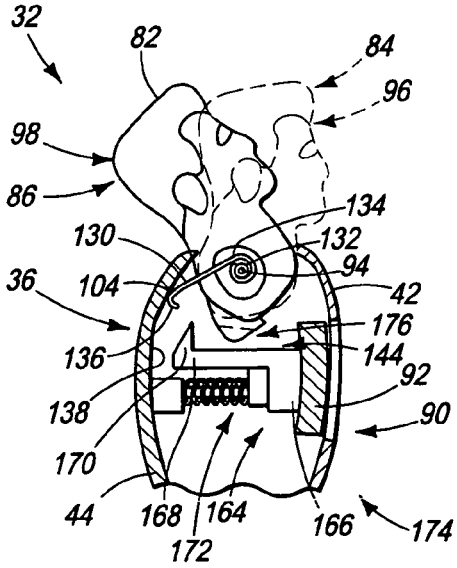
FIG. 6 is a partial sectional view of the mechanism of FIG. 5, with the retention member shown in a disengaged position and the head shown pivoted rearwardly relative to the upright position.

In a second exemplary head response, the head 82 of second figure 32 may be configured to pivot relative to the body 36 of second figure 32 in response to an impact to second figure 32. As shown in the nonexclusive illustrative example presented in FIGS. 1 and 2, head 82 may be pivotingly mounted to the body 36 of second figure 32 such that head 82 is pivotingly movable relative to the body 36 of second figure 32 between a first position 84 and a second position 86. In some embodiments where the head of the second figure 32 is pivotingly mounted to body 36, head 82 may be configured to pivot about an axis 94 (as shown in FIGS. 5 and 6) that is generally parallel to the base plane 28.

When the head 82 of second figure 32 is configured to pivot relative to the body 36 of second figure 32 in response to an impact to second figure 32, head 82 may be in a generally upright position 96 when the head is in first position 84. For example, as shown in FIG. 1, head 82 may generally be aligned with body 36 when head 82 is in first position 84. The head 82 of second figure 32 may transition to the second position by pivoting about any suitable axis. In some embodiments, as shown in the nonexclusive illustrative examples presented in FIG. 1, the head 82 of second figure 32 is pivoted rearwardly relative to first position 84 when the head is in second position 86, as indicated generally at 98. In some embodiments, as shown in the nonexclusive illustrative examples presented in FIG. 1, the head 82 of second figure 32 is pivoted forwardly relative to first position 84 when the head is in second position 86, as indicated generally at 100.

The heads 80, 82 of the respective first and second figures 30, 32 may be biased toward second position 86. For example, the first and second figures 30, 32 may include an elastic biasing member 104 that is configured to urge the heads 80, 82 of the respective first and second figures 30, 32 toward second position 86, such as from first position 84 toward second position 86.

Figure 3:
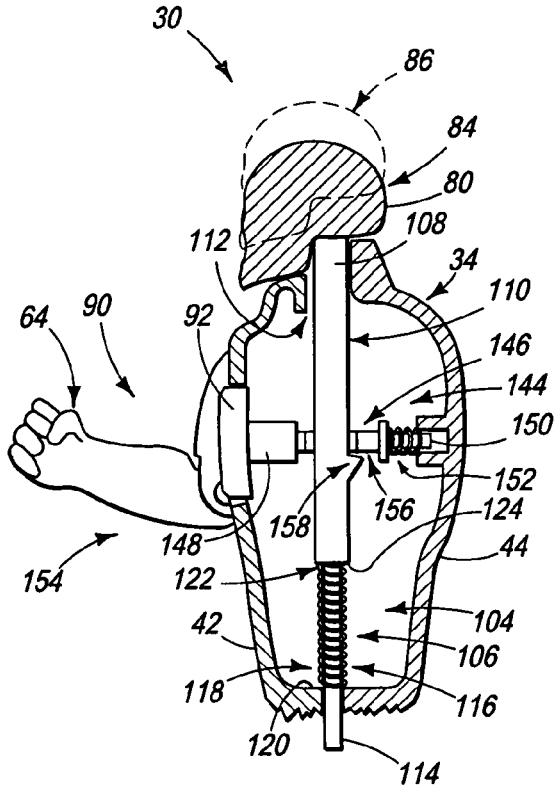
FIG. 3 is a partial sectional view of a figure suitable for use with a fighting figure game, taken generally along line 3-3 in FIG. 2, which shows a nonexclusive illustrative example of a mechanism for moving the head of the figure upwardly relative to the body, with a retention member shown in an engaged position and the head shown retained proximate the body of the figure.
Figure 4:
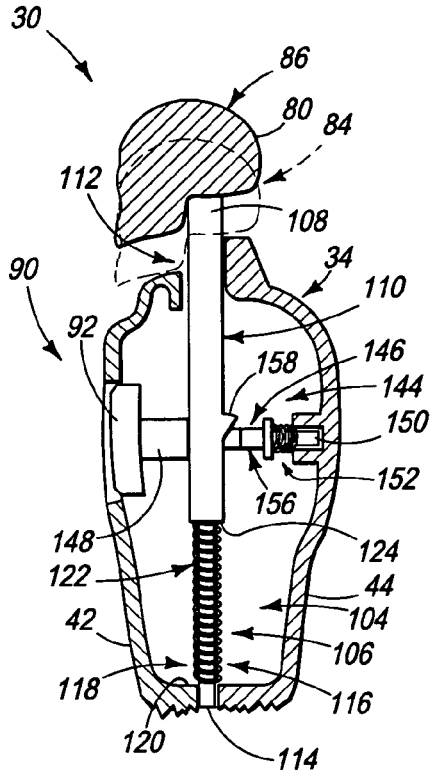
FIG. 4 is a partial sectional view showing the mechanism of FIG. 3, with the retention member shown in a disengaged position and the head shown upwardly spaced from the body of the figure.

As a first example, first figure 30 may include an elastic biasing member 106 configured to urge the head 80 of first figure 30 away from the body 34 of first figure 30, as shown in FIGS. 3 and 4. For example, elastic biasing member 106 may be configured to urge head 80 from first position 84, where head 80 is proximate body 34, toward second position 86, where head 80 is spaced upwardly away from body 34.

As shown in the nonexclusive illustrative example presented in FIGS. 3 and 4, the head 80 of first figure 30 may be disposed on a first end 108 of a neck shaft 110, which is slidingly movable relative to the body 34 of first figure 30. Neck shaft 110 passes through a neck opening 112 and extends downwardly in body 34 toward a second end 114. Elastic biasing member 106 is configured to urge neck shaft 110 and head 80 upwardly relative to body 34. Elastic biasing member 106 may be of any suitable structure, such as a coil spring or any other suitable elastic element such as a rubber band, a cantilevered structure, or the like. For example, as shown in the nonexclusive illustrative example presented in FIGS. 3 and 4, elastic biasing member 106, in the form of a coil spring, is disposed around a portion 116 of neck shaft 110 such that the first end 118 of elastic biasing member 106 bears against a surface or ledge 120 inside body 34 and the second end 122 of elastic biasing member 106 bears against a surface or ledge 124 on neck shaft 110. In such an example, elastic biasing member 106 would be in a compressed or energized state when head 80 is in the first position 84 proximate body 34, as shown in FIG. 3.

As a second example, second figure 32 may include an elastic biasing member 130 configured to urge the head 82 of second figure 32 to pivotingly move from a first position 84 toward a second position 86, as shown in FIGS. 5 and 6. For example, as shown in the nonexclusive illustrative example presented in FIGS. 5 and 6, elastic biasing member 130 may be configured to urge head 82 to pivot rearwardly from a generally upright position 96 toward position 98. In some embodiments, such as suggested in FIG. 1, elastic biasing member 130 may be configured to urge head 82 to pivot forwardly from a generally upright position 96 toward position 100.

As shown in the nonexclusive illustrative example presented in FIGS. 5 and 6, the head 82 of second figure 32 may include a pair of opposed pivots pins 132, which pivotingly engage the body 36 of the second figure 32, such that head 82 may pivot relative to body 36. The pivot pins 132 permit head 82 to pivot about axis 94. In the example presented in FIGS. 5 and 6, elastic biasing member 130 is configured to urge the head 82 of second figure 32 to pivot rearwardly from a generally upright position 96 toward position 98. Elastic biasing member 130 may include any suitable structure capable of providing head 82 with a rotational bias relative to body 36, such as a torsional coil spring, or any other suitably configured elastic element such as a rubber band, a cantilevered structure, or the like. For example, as shown in the nonexclusive illustrative example presented in FIGS. 5 and 6, elastic biasing member 130 may be a torsional coil spring disposed about at least one of pivot pins 132. A first end 134 of elastic biasing member 130 may be secured to head 82 and a second end 136 of elastic biasing member 130 may bear against any suitable interior surface 138 within body 36, as shown in FIGS. 5 and 6. In such an example, elastic biasing member 130 would be in a wound or energized state when head 82 is in the generally upright position 96, as shown in FIG. 5.

The heads 80, 82 of the respective first and second figures 30, 32 may be releasably retained in first position 84. For example, the first and second figures 30, 32 may include a retention member 144 configured to retain the heads 80, 82 of the first and second figures 30, 32 in the first position 84. The first and second figures 30, 32 may be configured such that an impact of at least a predetermined force to a chest region 90, such as to chest button 92, disengages retention member 144 and enables the head of the figure to move from first position 84 toward second position 86.

As a first example, first figure 30 may include a retention member 146 configured to retain the head 80 of the first figure 30 proximate the body 34. For example, retention member 146 may be configured such that striking a chest region 90, such as chest button 92, of the first figure 30 disengages the retention member, which may enable the elastic biasing 106 member to urge the head 80 upwardly away from the body 34 of the first figure 30.

As shown in the nonexclusive illustrative example presented in FIGS. 3 and 4, retention member 146 may extend from a first end 148 that is connected to chest button 92 toward a second end 150. An elastic biasing member, such as spring 152, forwardly urges retention member 146 and chest button 92 toward an engaged position 154, as shown in FIG. 3. When retention member 146 is in engaged position 154, a ledge 156 on retention member 146 engages a corresponding ledge 158 on neck shaft 110 such that neck shaft 110 and head 80 of first figure 30 are retained in first position 84 proximate the body 34 of first figure 30, as shown in FIG. 3. When chest button 92 is depressed, such as due to an impact to the chest region 90 of first figure 30, the ledge 156 on retention member 146 is disengaged from the ledge 158 on neck shaft 110 such that elastic biasing member 106 may urge neck shaft 110 and head 80 upwardly away from the body 34, as shown in FIG. 4.

As a second example, second figure 32 may include a retention member 164 configured to retain the head 82 of the second figure 32 in the first position 84. For example, retention member 164 may be configured such that striking a chest region 90, such as chest button 92, of second figure 32 disengages the retention member 164, which may enable elastic biasing member 130 to urge the head 82 of second figure 32 to pivotingly move from a first position 84 toward a second position 86.

As shown in the nonexclusive illustrative example presented in FIGS. 5 and 6, retention member 164 may extend from a first end 166 that is connected to chest button 92 toward a second end 168, which includes a hook 170. An elastic biasing member, such as spring 172, forwardly urges retention member 164 and chest button 92 toward an engaged position 174, as shown in FIG. 5. When retention member 164 is in engaged position 174, hook 170 engages a recess 176 on head 82 such that head 82 is retained in first position 84, as shown in FIG. 5. When chest button 92 is depressed, such as due to an impact to the chest region 90 of second figure 32, hook 170 becomes disengaged from recess 176 such that elastic biasing member 130 may urge head 82 to pivot from first position 84 toward second position 86, as shown in FIG. 6. As shown in the nonexclusive illustrative example presented in FIGS. 5 and 6, when hook 170 becomes disengaged from recess 176, elastic biasing member 130 urges head 82 to pivot rearwardly from an upright position 96 toward position 98. In some embodiments, as suggested in FIG. 1, when hook 170 becomes disengaged from recess 176, elastic biasing member 130 may urge head 82 to pivot forwardly from an upright position 96 toward position 100.

At least one of the first and second figures 30, 32 may include a punching mechanism 182, such as one configured to permit a user to extend at least one appendage 64, such as at least one of the first and second arms 66, 68, of the at least one figure. As shown in the nonexclusive illustrative example presented in FIGS. 7-9, at least one of the first and second figures, such as second figure 32 may include a punching mechanism 182 that may be entirely enclosed within the body 36 of the figure, such as within the leg 184, torso 186, and arm 188 of the figure.

Figure 9:
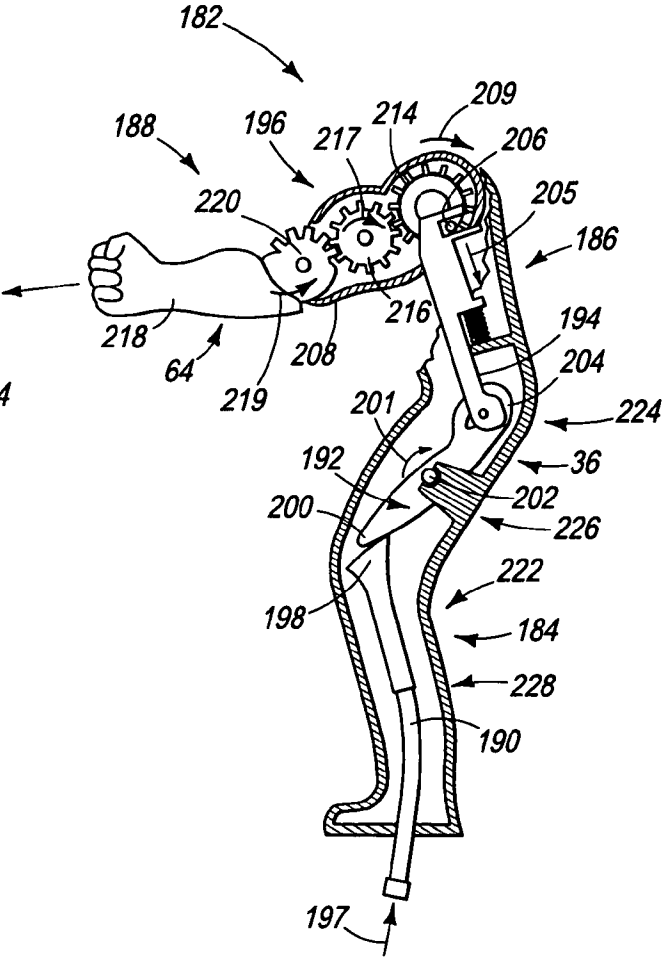
FIG. 9 shows the punching mechanism of FIGS. 7-8 with the arm extended away from the body.
Figure 8:
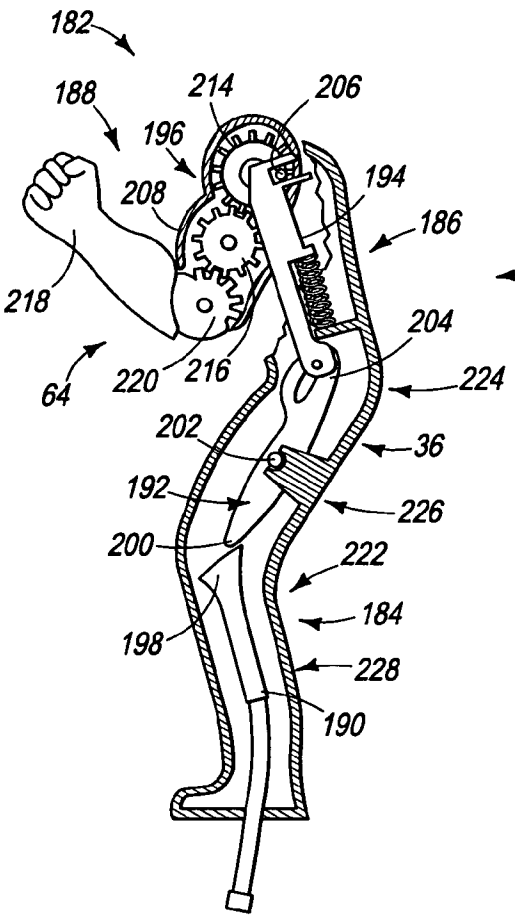
FIG. 8 is a partial section view of the figure of FIG. 7, taken generally along line 8-8 in FIG. 7, showing the punching mechanism with the arm in a retracted position.
Figure 7:
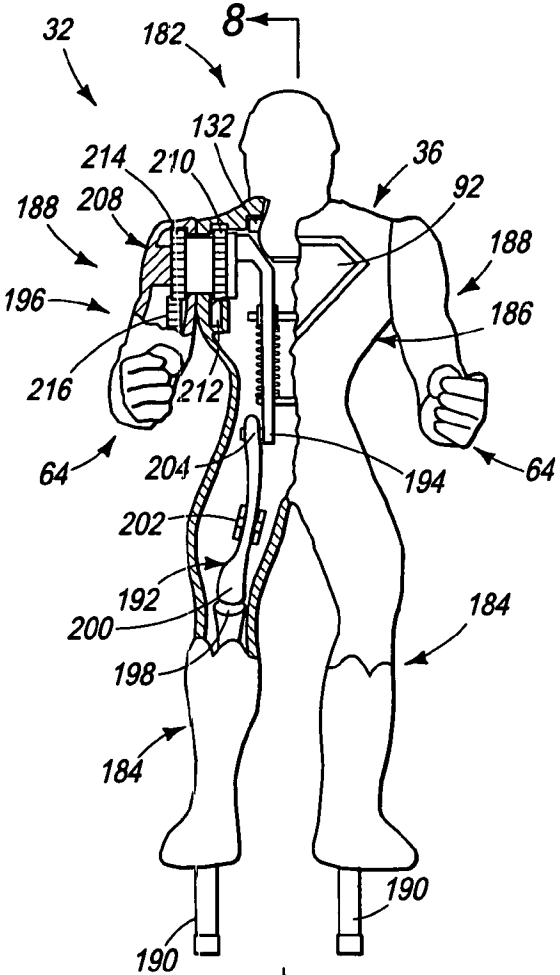
FIG. 7 is a partially broken away front view of a figure suitable for use with a fighting figure game, showing a nonexclusive illustrative example of a punching mechanism suitable for use with a fighting figure game.

As shown in the nonexclusive illustrative example presented in FIGS. 7-9, punching mechanism 182 includes a first or lower leg actuating link 190, a second or upper leg actuating link 192, a third or torso actuating link 194, and an arm extending mechanism 196. The illustrated arm extending mechanism 196 operates in a manner that is generally similar to the arm extending mechanism disclosed in U.S. Pat. No. 3,235,259 to Glass et al., the complete disclosure of which is incorporated by reference in its entirety for all purposes.

Extension of the arm 188 associated with the punching mechanism 182 illustrated in FIGS. 7-9 is initiated with an upward motion 197 of lower leg actuating link 190. As a nonexclusive illustrative example, lower leg actuating link 190 may be upwardly urged in response to a user pressing a button on an actuator, such as one of buttons 72, 74 on actuator 70 (illustrated in FIGS. 1 and 2). The buttons may be operatively linked to the lower leg actuating link 190 using any suitable mechanism. For example, the buttons may be linked to the lower leg actuating link 190 via any suitable mechanism configured to convert a downward motion of the button into an upward motion of the lower leg actuating link 190, such as a pivoting lever, which may be generally similar to the levers disclosed in U.S. Pat. No. 3,235,259 to Glass et al., the complete disclosure of which is incorporated by reference in its entirety for all purposes.

As lower leg actuating link 190 moves upward, its upper end 198 urges the first end 200 of the upper leg actuating link 192 upward, which causes the upper leg actuating link 192 to pivot in a clockwise direction 201 (as illustrated in FIGS. 8 and 9) about pivot pin 202. As the upper leg actuating link 192 pivots in clockwise direction 201, the second end 204 of the upper leg actuating link 192, which is pinned to the torso actuating link 194, urges the torso actuating link 194 to move in a downward direction 205. As the torso actuating link 194 moves in a downward direction 205, it engages arm actuating pin 206, which is fixed to the upper arm shell 208, and causes the upper arm shell 208 to rotate in a clockwise direction 209 (as illustrated in FIGS. 8 and 9). As the upper arm shell 208 rotates, toothed wheel or gear 210 is prevented from rotating by pawl 212. Toothed wheel or gear 214, which is coaxial with and irrotationally fixed to gear 210, is thus also prevented from rotating by pawl 212. As upper arm shell 208 rotates in clockwise direction 209, toothed wheel or gear 216 is caused to rotate in a clockwise direction 217 as gear 216 rotates about gear 214. The lower arm 218 is made to rotate in a counterclockwise direction 219 as the upper arm shell 208 rotates in a clockwise direction 209 and extends due to the engagement of gear 216 with the toothed portion 220 of lower arm 218.

A figure that includes a punching mechanism such as punching mechanism 182 may be modeled to include significantly bent leg joints, such as the knee 222 and/or the hips 224. For example, as shown in FIGS. 8 and 9, the upper leg 226 of the figure may be obliquely or even perpendicularly oriented relative to the lower leg 228 because pivoting motion of upper leg actuating link 192 will readily transfer vertical motions from the lower leg actuating link 190 to the torso actuating link 194 regardless of the orientation of the upper leg actuating link 192.

A figure that includes a punching mechanism such as punching mechanism 182, which includes a pawl 212 engaged with toothed wheel or gear 210, may permit a user to configure the location at which arm 188 impacts a target. For example, a user may configure arm 188 to impact a target at a higher or lower point by rotating the upper arm shell 208 relative to the torso 186 while preventing relative rotation between the upper arm shell 208 and the lower arm 218, which will cause pawl 212 to engage the toothed wheel or gear 210 at a different point, which will cause arm 188 to impact a target in a different position.

It is believed that the disclosure set forth herein encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the disclosure includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower or equal in scope to the original claims, are also regarded as included within the subject matter of the inventions of the present disclosure.

We claim:

1. A fighting figure game, comprising:

a base;

a first figure, comprising:

a first body selectively movable relative to the base;

at least a first appendage coupled to and extending from the first body; and a first head mounted to the first body, wherein the first head is movable relative to the first body between a first position and a second position; and a second figure, comprising:

a second body selectively movable relative to the base;

at least a second appendage coupled to and extending from the second body; and a second head mounted to the second body, wherein the second head is pivotingly movable relative to the second body between a third position and a fourth position and a biasing member configured to provide a biasing force to urge the second head to the fourth position.

2. The fighting figure game of claim 1, wherein at least one of the first and second bodies includes a chest region and an impact of at least a predetermined force to the chest region of the at least one body enables the head of the at least one body to move from the respective first or third position toward the respective second or fourth position.

3. The fighting figure game of claim 1, wherein at least one of the first and second heads is releasably retained in the respective first or third position.

4. The fighting figure game of claim 1, wherein at least one of the first and second figures further comprises a retention member configured to retain the respective first or second head of the at least one of the first and second figures in the respective first or third position, wherein an impact of at least a predetermined force to a chest region of the respective one of the first and second bodies of the at least one of the first and second figures disengages the retention member and enables the respective first or second head to move from the respective first or third position toward the respective second or fourth position.

5. The fighting figure game of claim 1, wherein the base extends generally along a base plane, and the second head is configured to pivot about an axis that is generally parallel to the base plane.

6. The fighting figure game of claim 1, wherein the second head is in a generally upright position when the second head is in the third position and the second head is pivoted rearwardly from the third position when the second head is in the fourth position.

7. The fighting figure game of claim 1, wherein the second head is in a generally upright position when the second head is in the third position and the second head is pivoted forwardly from the third position when the second head is in the fourth position.

8. A fighting figure game, comprising:

a base extending generally along a base plane;

a pair of opposed figures that are independently selectively movable along the base, each figure of the pair of figures comprising:

a body; and at least one appendage coupled to the body and configured to selectively extend away from the body;

a first figure of the pair of figures further comprising a head configured to pivot relative to the body of the first figure in response to the first figure being struck and the first figure has an elastic biasing member configured to urge the head of the first figure from a first position toward a second position.

9. The fighting figure game of claim 8, comprising a control assembly associated with each figure, wherein manipulation of the control assembly enables movement of the associated one of the figures relative to the base and extension of the respective at least one appendage.

10. The fighting figure game of claim 9, further comprising a platform supporting each figure and configured to move relative to the base, and the control assembly associated with each figure comprises a control handle coupled to the platform supporting the associated figure and configured to permit a user to move manually the associated figure relative to the base by moving the control handle.

11. The fighting figure game of claim 10, comprising at least one actuator disposed on the control handle, wherein the actuator is configured to permit a user to extend the at least one appendage of the associated figure.

12. The fighting figure game of claim 8, wherein the elastic biasing member of the first figure is configured to pivot the head of the first figure from the first position to the second position.

13. The fighting figure game of claim 12, wherein the first figure comprises a retention member configured to retain the head of the first figure in the first position.

14. The fighting figure game of claim 13, wherein movement of a chest region of the body of the first figure disengages the retention member such that the elastic biasing member urges the head of the first figure away from the first position.

15. The fighting figure game of claim 8, wherein the first figure comprises a retention member configured to retain the head of the first figure in the first position.

16. The fighting figure game of claim 8, wherein the head of the first figure is generally aligned with the body when the head is in the first position and the head is pivoted rearwardly from the first position when the head is in the second position.

17. The fighting figure game of claim 8, wherein the head of the first figure is generally aligned with the body when the head is in the first position and the head is pivoted forwardly from the first position when the head is in the second position.

18. A fighting figure game, comprising:

a base;

a first figure, comprising:

a body selectively movable relative to the base; and a head configured to move in response to an impact to the first figure; and a second figure, comprising:

a body selectively movable relative to the base; and a head configured to pivot relative to the body of the second figure in response to an impact to the second figure, wherein an elastic biasing member provides a biasing force to move the head of the second figure from a first position toward a second position.

19. The fighting figure game of claim 18, wherein:

the head of the first figure is configured to move upwardly away from the body of the first figure in response to an impact to a chest region of the first figure; and the head of the second figure is configured to pivot relative to the body of the second figure in response to an impact to a chest region of the second figure.

20. A method of releasably securing a head of toy figure, the method comprising:

pivotally mounting a head of at least one of a pair of fighting figures movably secured to a platform;

biasing the head of the at least one of the pair of fighting figures from a first position towards a second position with an elastic biasing member, wherein the head pivots with respect to a body of the at least one of the pair of fighting figures as it moves from the first position to the second position;

retaining the head in the first position with a releasable mechanism; and releasing the releasable mechanism when a body portion of the at least one of the pair of fighting figures is contacted by another one of the pair of fighting figures, wherein the head pivots from the first position to the second position when the releasable mechanism is released.

* * * * *